United States Patent [19]

Ikeda et al.

[11] Patent Number: 4,836,754

[45] Date of Patent: Jun. 6, 1989

[54] TURBULENCE GENERATING DEVICE ADJACENT THE INLET END OF EACH DISCHARGE PORT OF A MULTI-CYLINDER PISTON-TYPE COMPRESSOR FOR PROVIDING INTERNAL PULSATION AND NOISE SUPPRESSION

[75] Inventors: Hayato Ikeda; Satoshi Kitahama; Hiroshi Onomura, all of Kariya, Japan

[73] Assignee: Kabushiki Kaisha Toyoda Jidoshokki Seisakusho, Aichi, Japan

[21] Appl. No.: 116,367

[22] Filed: Nov. 2, 1987

[30] Foreign Application Priority Data

Nov. 4, 1986 [JP] Japan ..... 61-170042[U]

[51] Int. Cl.[4] ..... F04B 1/16; F04B 1/18

[52] U.S. Cl. ..... 417/269; 417/312

[58] Field of Search ..... 417/269, 312, 313, 559, 417/569, 571; 137/855, 856

[56] References Cited

U.S. PATENT DOCUMENTS

| | | | |
|---|---|---|---|
| 3,241,748 | 3/1966 | Cramer et al. | 417/571 X |
| 4,534,710 | 8/1985 | Higuchi et al. | 417/269 |
| 4,652,217 | 3/1987 | Shibuya | 417/269 |
| 4,715,790 | 12/1987 | Iijima et al. | 417/269 |

FOREIGN PATENT DOCUMENTS

| | | | |
|---|---|---|---|
| 84211 | 7/1978 | Japan | 417/571 |
| 52691 | 3/1982 | Japan | 417/571 |
| 58179 | 4/1984 | Japan | 417/312 |

*Primary Examiner*—William L. Freeh

*Attorney, Agent, or Firm*—Burgess, Ryan & Wayne

[57] ABSTRACT

A multi-cylinder piston type compressor having an axially extending cylinder block with cylinder bores formed therein and closed on at least one axial end by a housing defining therein suction and discharge chambers and provided therein with a reciprocative piston mechanism for drawing, compressing, and discharging a refrigerant gas. The compressor also has a valve plate member arranged between the cylinder block and the housing for defining therein suction ports and discharge ports, a suction valve sheet member defining therein suction valves openably closing the suction ports and discharge apertures for introducing the refrigerant gas after compression from the cylinder bores into the discharge chamber of the housing via the discharge port of the valve plate member. The compressor also has an internal pulsation and noise suppression unit provided by extensions formed in the suction valve sheet member and adjacent to the discharge ports of the valve plate member.

7 Claims, 8 Drawing Sheets

TURBULENCE GENERATING DEVICE ADJACENT THE INLET END OF EACH DISCHARGE PORT OF A MULTI-CYLINDER PISTON-TYPE COMPRESSOR FOR PROVIDING INTERNAL PULSATION AND NOISE SUPPRESSION

BACKGROUND OF THE INVENTION

1. Field of the Invention

The present invention relates to a multi-cylinder piston type compressor, such as a multi-cylinder swash-plate type compressor or a multi-cylinder wobble-plate type compressor adapted for use in compressing a refrigerant gas of an air-conditioning system, e.g., a car air-conditioning system. More particularly, it relates to a pulsation and noise suppression means accommodated inside the multi-cylinder piston type compressor.

2. Description of the Related Art

U.S. Pat. No. 4,534,710 of Higuchi et al discloses a typical multi-cylinder swash-plate type compressor for use in automobile air-conditioning systems. The conventional compressor has an axially extending cylinder block in which a multi-cylinder piston type compressing system operated by a single rotary swash plate is contained. The front and rear ends of the cylinder block are closed by front and rear housings in which suction and discharge chambers for a refrigerant gas are arranged.

The refrigerant gas returning from the air-conditioning system is drawn into the suction chambers of the front and rear housings, and subsequently introduced into the cylinder bores in which the refrigerant gas is compressed by the reciprocating motion of the pistons. The compressed refrigerant gas is then pumped out of the cylinder bores into the discharge chambers of the front and rear housings. The conventional compressor is also provided with a valve plate arranged between each of the front and rear ends of the cylinder block and the front or rear housing. The valve plate has a plurality of suction ports allowing communication between the suction chamber and the cylinder bores and a plurality of discharge ports allowing communication between the cylinder bores and the discharge chamber, and on both sides of the valve plate, a suction valve sheet and a discharge valve sheet are arranged.

FIG. 11 typically illustrates the arrangement of a part of the rear end portion of the conventional multi-cylinder swash plate type compressor. That is, a valve plate 10 is arranged between the rear end of the cylinder block 1 and a rear housing 11. The valve plate 10 is attached to the rear end of the cylinder block 1 via a suction valve sheet 21 having suction valves 21*a* for openably closing suction ports 10*a* of the valve plate 10 and discharge apertures 21*b* aligned with discharge ports 10*b* of the valve plate 10. A discharge valve sheet 18 having a plurality of discharge valves for openably closing the discharge ports 10*b* of the valve plate 10 and a valve retainer 19 are attached to the outer end face of the valve plate 10 by a screw bolt. The refrigerant gas is drawn from a suction chamber 12 into each cylinder bore 4 through each suction port 10*a* of the valve plate 10 when each suction valve 21*a* is opened due to the pumping-in action of a piston 5 reciprocating within the corresponding cylinder bore 4. When the piston 5 carries out a compressing motion by moving toward the rear end of the cylinder block 1, the refrigerant gas is compressed within the cylinder bore 4 until a predetermined pressure level is reached. When the predetermined pressure level is reached, the compressed gas forcibly opens the discharge valve of the discharge valve sheet 18 by pushing the discharge valve toward the valve retainer 19 and is pumped out of the cylinder bore 4 into a discharge chamber 13 of the rear housing 11, via the discharge aperture 21*b* of the suction valve sheet 21 and the discharge port 10*b* of the valve plate 10. Since the actions of a suction and compression of the refrigerant gas are regularly repeated by the reciprocating motion of the multi-cylinder pistons 5, the flow of the compressed refrigerant gas pumped into the discharge chamber 13 of the rear housing 11 from the cylinder bores 4 includes a pulsation in the pressure thereof at a frequency corresponding to $N \times M$ (N indicates number of the cylinder bores 4, and M indicates number of rotations of the compressor), and causes vibration to occur at each discharge valve of the discharge valve sheet 18, thus generating noise. The same pulsation and vibration phenomena also appears at the front side of the compressor. At this stage, each discharge aperture 21*b* of the suction valve sheet 21 is formed so that it is larger than the corresponding discharge port 10*b* of the valve plate 10. Therefore, when each piston 5 carries out the compression stroke, the compressed refrigerant gas pumped out of the cylinder bores 4 flows through the discharge ports 10*b* of the valve plate 10 as a non-turbulent flow of gas, as illustrated in FIG. 11, and enters the discharge chamber 13 in the rear housing 11. On the other hand, at the initial, intermediate, and final stages of the compression stroke of the respective pistons 5, there is a change in the direction and the pressure of the compressed refrigerant gas pumped out of the respective cylinder bores 4, i.e., the strength of flow of the compressed refrigerant gas, and as a result, when the compressed refrigerant gas collides with the discharge valves, the discharge valves of the discharge valve sheet 18 in turn act to increase the strength of flow of the compressed refrigerant gas, due to the flexible characteristics of these discharge valves, and vibrate at a half-open position thereof, as illustrated by the broken line in FIG. 11. Consequently, the magnitude of the discharge pulsation in the pressure of the compressed refrigerant gas as well as the noise level due to vibration of the discharge valves of the discharge valve sheet 18 increases at a specified frequency pulsation band. According to experiments by the present inventors, it was confirmed that the magnitude of the discharge pulsation in the compressed refrigerant gas becomes particularly large at a frequency band of approximately 0.4 KHz, as shown in FIG. 4. It was further confirmed that the noise level becomes high due to a large vibration of the discharge valves at a pulsation frequency band of approximately 0.9 KHz, as shown in FIG. 5, or at a particular number of rotations of the compressor, i.e., at approximately 900, 2,000, and 3,600 r.p.m, as shown in FIG. 6.

U.S. Pat. No. 4,534,710 discloses damping chambers arranged adjacent to the suction and discharge ports for suppressing pulsation in suction and discharge pressure of the refrigerant gas. However, the damping chambers of this conventional compressor are arranged outside the compressor body, and thus, the overall height of such a conventional compressor is relatively high. Therefore, there is a need for an appropriate internally arranged construction capable of suppressing pulsation in the discharge pressure of the compressed refrigerant gas.

SUMMARY OF THE INVENTION

Therefore, an object of the present invention is to provide a multi-cylinder piston type compressor provided with an internal means for suppressing pulsation in the discharge pressure of the refrigerant gas as well as reducing noise caused by a vibration of the discharge valves during the operation of the compressor.

Another object of the present invention is to provide an improved compressor element adapted for use in suppressing pulsation in the discharge pressure of the refrigerant gas of a multi-cylinder piston type compressor, whereby existing multi-cylinder piston type compressors can be readily modified to solve the above-mentioned pulsation and vibration problems.

In accordance with the present invention, there is provided a multi-cylinder piston type compressor provided with an axially extending cylinder block having a plurality of axial cylinder bores arranged around a central axis thereof, a plurality of reciprocatory pistons received in the axial cylinder bores of the cylinder block for drawing, compressing, and discharging a refrigerant gas, a drive mechanism for causing reciprocative movement of the pistons, at least one housing arranged so as to close one of the axial ends of the cylinder block and having therein suction and discharge chambers, a valve plate member having a substantial thickness arranged between said one of the axial ends of the cylinder block and the housing and having a plurality of suction ports to allow ingress of a refrigerant gas to be compressed from the suction chamber into the cylinder bores of the cylinder block and a plurality of discharge ports for discharging a compressed refrigerant gas from the cylinder bores of the cylinder block toward the discharge chamber of the housing, each of the plurality of discharge ports having an inner end adjacent to each of the plurality of cylinder bores and an outer end adjacent to the discharge chamber of the housing, a suction valve sheet member arranged between said one of the axial ends of the cylinder block and the valve plate member and defining a plurality of suction valves movable to open and close the plurality of suction ports in response to a reciprocation of the plurality of reciprocatory pistons and a plurality of discharge apertures for permitting the compressed refrigerant gas to flow from the cylinder bores of the cylinder block toward the discharge ports of the valve plate member, a discharge valve sheet member arranged between the valve plate member and the housing and defining a plurality of discharge valves movable to open and close the discharge ports of the valve plate member in response to a reciprocation of the plurality of reciprocatory pistons, and a turbulence generating unit arranged adjacent to each inlet end of each discharge port for generating a turbulence in a flow of the compressed refrigerant gas within each discharge port, to mitigate a pressure change in the compressed refrigerant gas flow, acting on each of the plurality of discharge valves to thereby suppress pulsation in a pressure of the compressed refrigerant gas. The turbulence generating unit comprises an extension formed in at least a part of an edge of each discharge aperture of the suction valve sheet member, the extension extending radially inwardly from the edge of each discharge aperture of the suction valve sheet member toward the center thereof.

BRIEF DESCRIPTION OF THE DRAWINGS

The present invention will be made more apparent from the ensuing description of the embodiments thereof with reference to the accompanying drawings, wherein.

DESCRIPTION OF THE PREFERRED EMBODIMENTS

Figure 1:
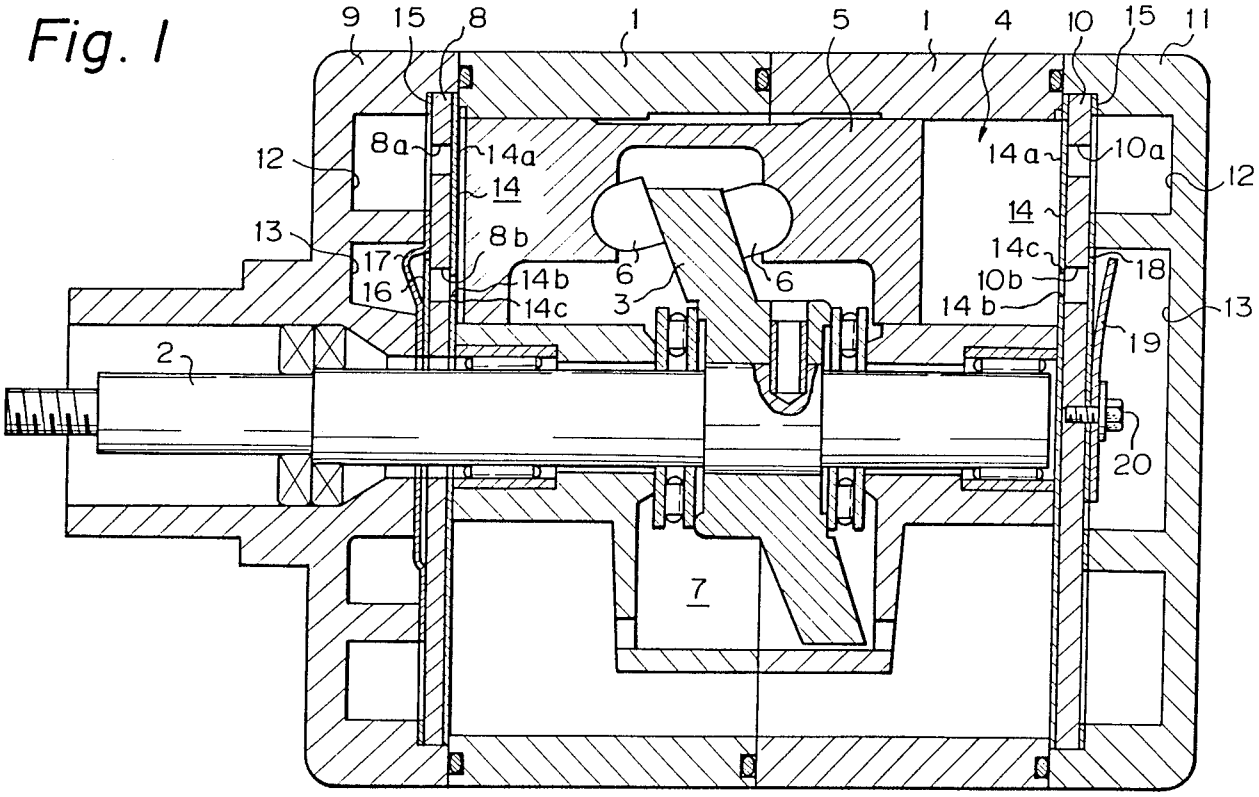
FIG. 1 is a longitudinal cross-sectional view of a multi-cylinder piston type compressor wherein a pulsation and vibration suppressing means according to the present invention is accommodated.

FIG. 1 illustrates an internal construction of a multi-cylinder swash plate type compressor embodying the present invention.

Referring to FIG. 1, the multi-cylinder swash plate type compressor has a cylinder block unit consisting of front and rear cylinder blocks 1 joined together, via an appropriate sealing member, in an axial alignment. A drive shaft 2 is rotatably supported in the center of the cylinder blocks 1 by front and rear radial bearings, and has a swash plate 3 fixed thereon which is axially supported by a pair of thrust bearings seated on inner ends of the front and rear cylinder block 1. Namely, the swash plate 3 is arranged so as to be rotated with the drive shaft 2 within a swash plate chamber 7 formed by combining the front and rear cylinder blocks 1. Defined in the cylinder block unit is a plurality of axially extending cylinder bores 4 arranged equiangularly around a central axis of the cylinder block unit, and within the cylinder bores 4, are slidably disposed a corresponding number of double-headed reciprocative pistons 5 driven by the swash plate 3 via half-sphere shoes 6. The swash plate chamber 7 is in fluid communication with a suction flange (not shown) for introducing a refrigerant gas returned from an outside refrigerating circuit. A front valve plate member 8 having a substantial thickness is attached to the front end of the cylinder block unit, and has suction ports **8*a* and discharge ports 8*b* formed therein and disposed adjacent to the respective cylinder bores 4. These suction and discharge ports 8***a* and 8*b* are formed as axially extended ports, respectively, due to the substantial thickness of the front valve plate member 8. On the outside of the front valve plate 8 is arranged a front housing 9 tightly connected, via an appropriate sealing member, to the front end of the cylinder block unit. Similarly, a rear valve plate member 10 having suction ports 10*a* and discharge ports 10*b*, and a rear housing 11, are connected to the rear end of the cylinder block unit. The rear valve plate member 10 also has a substantial thickness so that the suction and discharge ports are formed as axially extended ports, respectively. Defined in the front and rear housings 9 and 11 are front and rear suction chambers 12 arranged in the radially outer portion of each housing 9 and 11, and front and rear discharge chambers 13 arranged in the central portion of each housing 9 and 11. The suction chambers 12 are in fluid communication with the swash plate chamber 7 and receive the refrigerant gas to be compressed, and the discharge chambers 13 are in a fluid communication with a discharge flange (not shown) which delivers the compressed refrigerant gas toward the outside refrigerating circuit. Front and rear valve sheet members 14 made of a resilient material are arranged between the inner faces of the front and rear valve plate members 8 and 10 and the front and rear ends of the cylinder block unit. Respective suction valve sheet members 14 have suction valves 14a formed therein and disposed so as to be operable as reed valves for openably closing the suction ports 8*a* and 10*a* of the front and rear valve plate members 8 and 10 in response to a reciprocating movement of the pistons 5. Sealing members 15 are arranged as a seal between the outer faces of the front and rear valve plate members 8 and 10 and the front and rear housings 9 and 11, and between the front valve plate member 8 and the front housing 9 are arranged a front discharge valve sheet member 16 having discharge reed valves, which are operable to open and close the discharge ports 8*b*, and a valve retainer element 17. The discharge valve sheet member 16 and the valve retainer element 17 are secured to the outer face of the valve plate member 8 by a central boss of the front housing 9, and a rear discharge valve sheet member 18 having discharge reed valves which are operable to open and close the rear discharge ports 10*b*, and a valve retainer element 19 are secured to the outer face of the rear valve plate member 10 by a screw bolt 20.

Defined in the front and rear valve sheet members 14 are discharge apertures 14b arranged adjacent to the discharge ports 8*b* and 10*b* of the front and rear valve plate members 8 and 10 for introducing the compressed refrigerant gas from the cylinder bores 4 toward the discharge ports 8*b* and 10*b*. At this stage, according to the present invention, each of the suction valve sheet members 14 arranged on the front and rear sides of the cylinder block unit defines an extension 14*c* arranged at least a part of each of respective discharge apertures 14*b*, for generating a turbulence in the refrigerant gas flowing from the cylinder bore 4 into the discharge port 8*b* or 10*b*. The extension 14*c* of each suction valve sheet member 14 extends radially inwardly toward the center of the corresponding discharge aperture 14*b*, and may have various different shapes, as described below.

Figure 2:
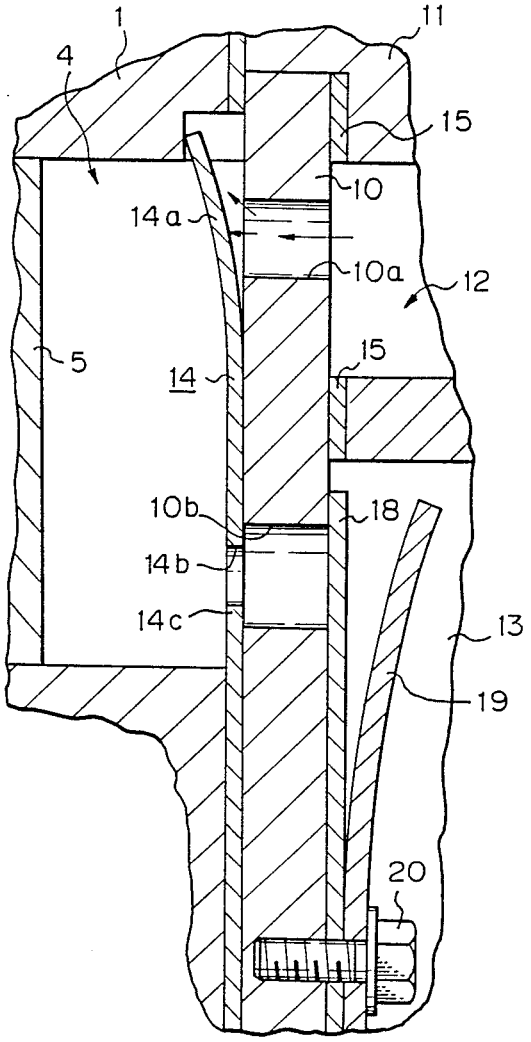
FIG. 2 is an enlarged cross-sectional view of a part of a multi-cylinder piston type compressor having an internal pulsation and vibration suppressing means according to an embodiment of the present invention, illustrating one state of the operation of the compressor.
Figure 3:
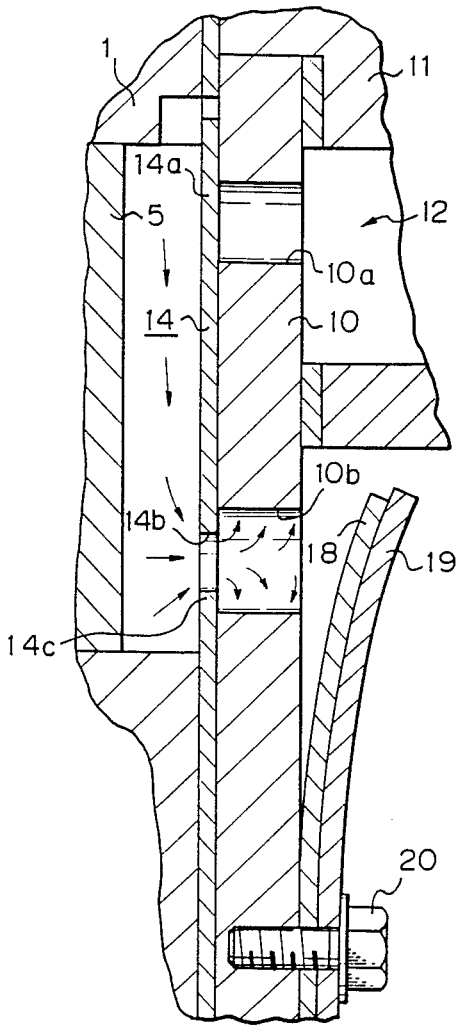
FIG. 3 is an enlarged cross-sectional view similar to FIG. 2, illustrating another state of the operation of the compressor.

FIGS. 2 and 3 are partial enlarged views of a portion of the rear side of the multi-cylinder swash plate type compressor as shown in FIG. 1, and illustrate a first embodiment of the extension 14*c* of the suction valve sheet member 14.

As illustrated in FIGS. 2 and 3, the extension 14*c* of the suction valve sheet member 14 has the shape of an annular extension defining a discharge aperture 14*b* concentric with and smaller than the discharge port 10*b* of the valve plate member 10.

The operation of the compressor of FIGS. 2 and 3 will now be described below with respect to the rear side thereof.

When the swash plate 3 is rotated by the rotation of the drive plate 2, the piston 5 reciprocates within the corresponding cylinder bore 4 while repeatedly carrying out alternate suction and compression strokes. During the suction stroke of the piston 5, the refrigerant gas to be compressed is introduced from the suction chamber 12 of the rear housing 11 into the cylinder bore 4 via the suction port 10*a* of the valve plate member 10, as illustrated in FIG. 2. The refrigerant gas in the cylinder bore 4 is subsequently compressed by the piston 5 carrying out the compression stroke, as illustrated in FIG. 3. During the compression stroke of the piston 5, the compressed refrigerant gas in the cylinder bore 4 flows through the discharge aperture 14*b* of the rear suction valve sheet member 14 into the discharge port 10*b* of the rear valve plate member 10, and then into the rear discharge chamber 13 via the opened discharge valve of the discharge valve sheet member 18. At this stage, since the annular extension 14*c* surrounding the discharge aperture 14*b* acts to choke the flow of the compressed refrigerant gas, pressure in the gas entering the axially extended discharge port 10*b* is reduced, due to a sudden volumetric expansion, and therefore, a turbulent flow of the compressed refrigerant gas is generated within the discharge port 10*b*. As a result, when the turbulent flow of the compressed refrigerant gas flows out of the discharge port 10 into the discharge chamber 13 while pressing the discharge valve toward the opened position, pulsation in the pressure of the compressed refrigerant gas is suppressed due to the generation of the turbulent flow. Consequently, vibration of the discharge valve of the discharge valve sheet member 18 due to collision therewith of the gas is remarkably suppressed, and a low noise level is maintained.

Figure 4:
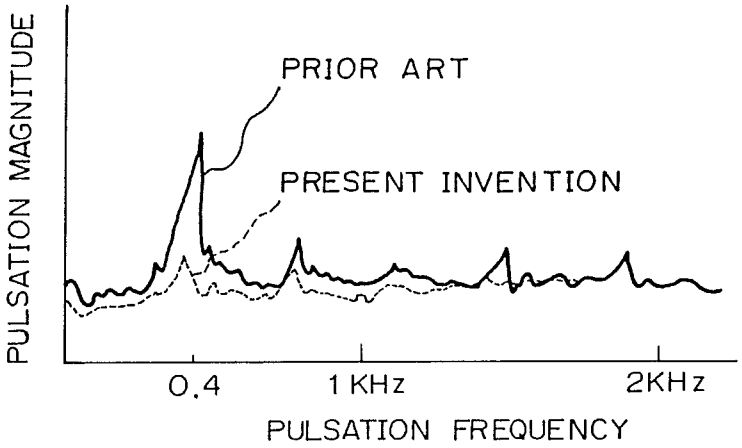
FIGS. 4 through 6 are graphs illustrating the result of a comparison between the present invention and the prior art, with respect to the pulsation in the discharge pressure of the refrigerant gas and the noise level due to a vibration of the discharge valves.

FIG. 4 illustrates the result of an experiment conducted by the present inventors for comparing the magnitude of pulsation in the discharged pressure of the compressed refrigerant gas with respect to the present invention and the prior art.

As clearly understood from the graph of FIG. 4, it was confirmed that the magnitude of the pulsation in the compressed refrigerant gas discharged from the compressor provided with the turbulence generating means of FIGS. 2 and 3 is extremely small compared with the prior art, not only at the frequency band of approximately 0.4 KHz but also over the entire frequency range of from approximately 0 to more than 2 KHz.

Figure 5:
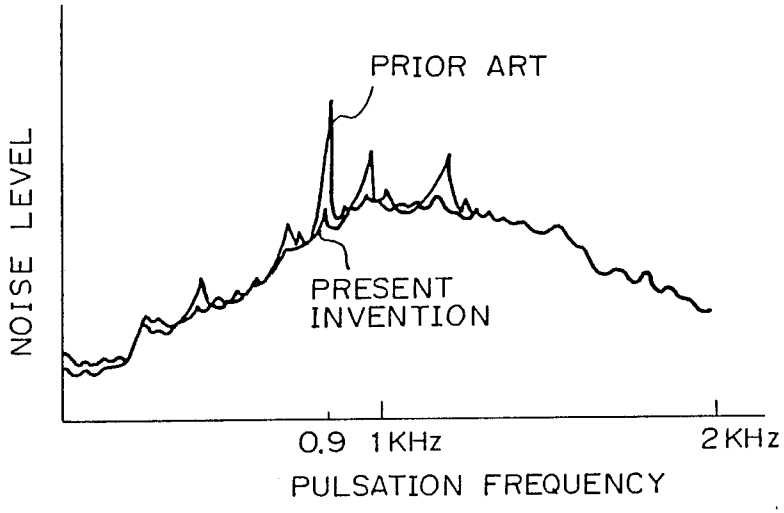
Figure 6:
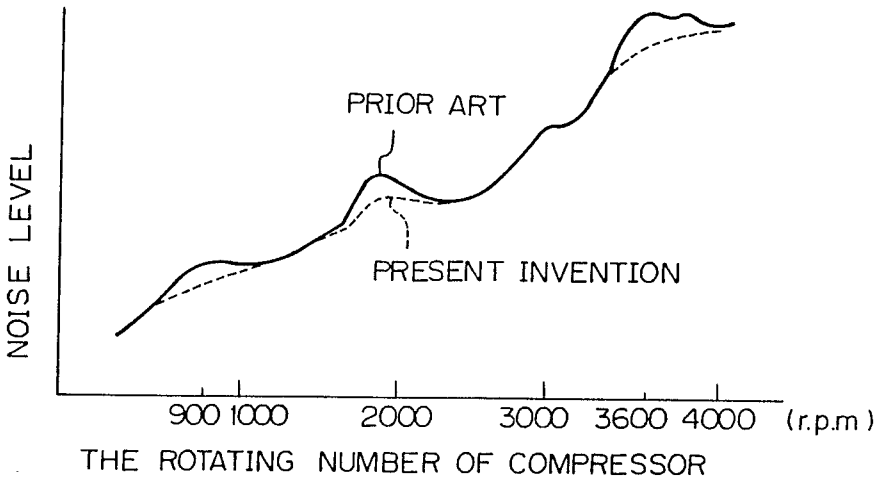

FIGS. 5 and 6 illustrate the result of another experiment conducted by the present inventors for comparing the level of the vibration noise with respect to the present invention and the prior art. From FIG. 5, it is understood that the noise level of the compressor of the present invention at an approximately 0.9 KHz pulsation frequency is extremely low, compared with the prior art. Also, it was confirmed that the noise level of the compressor of the present invention at rotations of approximately 900, 2,000, and 3,600 r.p.m is lower than that of the compressor of the prior art and has a tendency to increase linearly with an increase in the number of rotations of the compressor of the present invention, as shown in FIG. 6.

Figure 7:
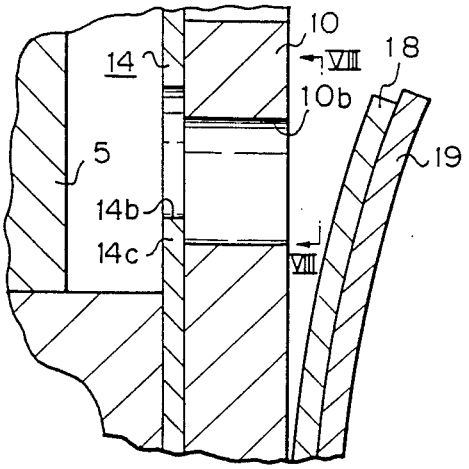
FIG. 7 is an enlarged cross-sectional view of a part of a multi-cylinder piston type compressor having an internal pulsation and vibration suppressing means according to another embodiment of the present invention.
Figure 8:
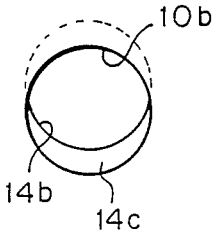
FIG. 8 is a partial side view taken along the line VIII-VIII of FIG. 7.

FIGS. 7 and 8 illustrate another embodiment of the extension 14*c* of the suction valve sheet 14. In the embodiment of FIGS. 7 and 8, the extension 14*c* is formed to extend radially inwardly by making the discharge aperture 14*b* smaller than the discharge port 10*b* so as to be eccentric to the discharge port 10*b*. This radially inward extending extension 14*c* can cause a turbulence in the flow of the compressed refrigerant gas within the discharge port 10*b*, and thus a suppression of the pulsation in the pressure of the compressed refrigerant gas, and a vibration of the discharge valve can be realized.

Figure 9:
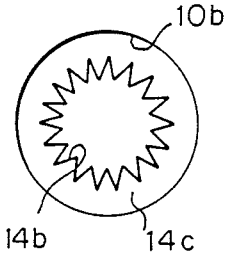
FIG. 9 is a front view of a portion of a discharge aperture of a suction valve sheet embodying the present invention.

FIG. 9 illustrates a further embodiment of the extension 14*c* of the suction valve sheet member 14. In the embodiment of FIG. 9, the extension 14*c* has a saw-tooth-like inner edge around the discharge aperture 14*b*. This saw-tooth-like inner edge of the radially inward extension 14*c* readily generates a turbulence in the compressed refrigerant gas within the discharge port 10*b* before the gas enters the discharge chamber 13 of the rear housing 11.

Figure 10:
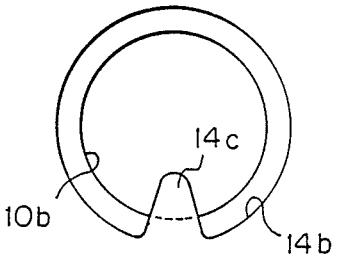
FIG. 10 is a front view of a portion of a discharge aperture of another suction valve sheet embodying the present invention.
Figure 11:
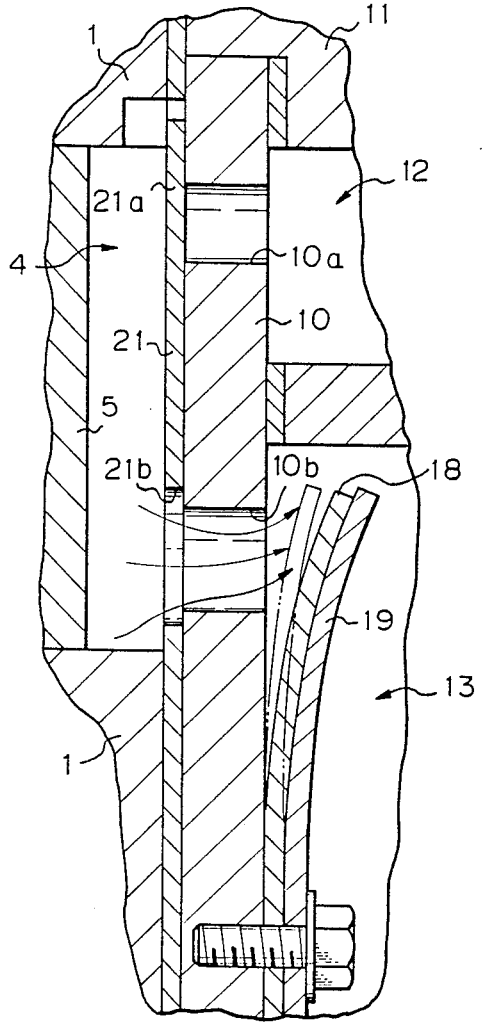
Fig. 11 ( PRIOR ART )
FIG. 11 is an enlarged cross-sectional view of a part of a conventional multi-cylinder piston type compressor.

FIG. 10 illustrates another embodiment of the extension 14*c* of the suction valve sheet member 14. In the embodiment of FIG. 10, the extension has the shape of a single projection projecting from the edge of the discharge aperture 14*b*. Thus, the projection-shaped extension 14*c* contributes to the generation of a turbulence in the compressed refrigerant gas within the discharge port 10*b*.

The foregoing description of the embodiments of the present invention is provided with respect to the rear side of the multi-cylinder double-headed piston type compressor. However, it should be understood that the same construction and arrangement are provided for the front section valve sheet member 14 of the compressor.

It should also be understood that the present invention can be adapted for a multi-cylinder wobble plate type compressor having single-headed pistons for compressing a refrigerant gas.

From the foregoing description of the embodiments of the present invention, it will be understood that, according to the present invention, there is provided a multi-cylinder piston type compressor having an effective internal pulsation and noise suppression construction and arrangement.

We claim:

1. A multi-cylinder piston type compressor provided with an axially extending cylinder block means having a plurality of axial cylinder bores arranged around a central axis thereof, a plurality of reciprocatory pistons received in said axial cylinder bores of said cylinder block means for drawing, compressing, and discharging a refrigerant gas, a drive mechanism for causing reciprocative movement of the pistons, at least one housing means arranged so as to close one axial end of said cylinder block means and having therein suction and discharge chambers, a valve plate means having a substantial thickness arranged between said one axial end of said cylinder block means and said housing means and having a plurality of suction ports for allowing entry of a refrigerant gas to be compressed from said suction chamber into said cylinder bores of said cylinder block means and a plurality of cylindrical discharge ports for discharging a compressed refrigerant gas from said cylinder bores of said cylinder block means toward said discharge chamber of said housing means, each of said plurality of discharge ports having an inner end adjacent to each of said plurality of cylinder bores and an outer end adjacent to said discharge chamber of said housing means, a suction valve sheet means arranged between said one axial end of said cylinder block means and said valve plate means and defining a plurality of suction valves movable to open and close said plurality of suction ports in response to reciprocation of said plurality of reciprocatory pistons and a plurality of discharge apertures for permitting the compressed refrigerant gas to flow from said cylinder bores of said cylinder block means toward said discharge ports of said valve plate means, and a discharge valve sheet means arranged between said valve plate means and said housing means and defining a plurality of discharge valve movable to open and close said discharge ports of said valve plate means in response to reciprocation of said plurality of reciprocatory pistons, wherein an improvement comprises turbulence generating means consisting essentially solely of the discharge apertures of said suction valve sheet means, said discharge apertures having an area less than the area of discharge ports of the value plate to thereby suppress pulsation in a pressure of said compressed gas flow.

2. A multi-cylinder piston type compressor according to claim 1, wherein said turbulence generating means comprise an extension formed in at least a part of an edge of each said discharge aperture of said suction valve sheet means, said extension extending radially inwardly from said part of said edge of each of said discharge apertures of said suction valve sheet means toward the center thereof.

3. A multi-cylinder piston type compressor according to claim 1, wherein each said discharge aperture of said suction valve sheet means includes an edge and said turbulence generating means includes an annular extension radially extending from the entire portion of said edge of each of said discharge apertures of said suction valve sheet means.

4. A multi-cylinder piston type compressor according to claim 3, wherein said annular extension has a plurality of saw-tooth shape projections.

5. A multi-cylinder piston type compressor according to claim 1, wherein said drive mechanism for causing reciprocative movement of said pistons comprises a swash plate mounted on an axial drive shaft rotatably held in said cylinder block means.

6. A multi-cylinder swash plate type compressor for use in compressing a refrigerant gas of an air-conditioning system comprising:

an axially extending cylinder block means having a plurality of axial cylinder bores arranged around a central axis thereof;

a swash-plate operated piston mechanism for drawing, compressing, and discharging the refrigerant gas;

front and rear housings arranged so as to close axial front and rear ends of said cylinder block means, each of said front and rear housings having therein a suction chamber from which the refrigerant gas is drawn into said plurality of axial cylinder bores of said cylinder block means and a discharge chamber into which the refrigerant gas is discharged from said plurality of cylinder bores of said cylinder block means;

front and rear valve plates having a substantial thickness arranged between said axial front and rear ends of said cylinder block means and said front and rear housings, each of said front and rear valve plates having a plurality of suction ports for allowing entry of the refrigerant gas before compression from said suction chamber into said cylinder bores of said cylinder block means and a plurality of cylindrical discharge ports for discharging the compressed refrigerant gas from said cylinder bores of said cylinder block means toward said discharge chamber of each said housing, each of said plurality of discharge ports having an inner end adjacent to each of said plurality of cylinder bores and an outer end adjacent to said discharge chamber of each of said front and rear housings;

front and rear suction valve sheets arranged between said axial front and rear ends of said cylinder block and said front and rear valve plates, each defining a plurality of suction valves movable to open and close said plurality of suction ports of a corresponding one of said front and rear valve plates in response to reciprocative movement of said plurality of reciprocatory pistons and a plurality of discharge ports for permitting the compressed refrigerant gas to flow from said cylinder bores of said cylinder block toward said discharge ports of the corresponding one of said front and rear valve plates;

front and rear discharge valve sheets arranged between said front and rear valve plates and said front and rear housings and defining a plurality of discharge ports movable to open and close said discharge ports of the corresponding one of said front and rear valve plates in response to reciprocation of said plurality of reciprocatory pistons; and turbulence generating means consisting essentially solely of the discharge ports of said suction valve sheets, said discharge ports of said value sheets having an area less than the area of the discharge ports of the valve plate to thereby suppress pulsation of said compressed refrigerant gas flow.

7. A multi-cylinder piston type compressor provided with an axially extending cylinder block means having a plurality of axial cylinder bores arranged around a central axis thereof, a plurality of reciprocatory pistons received in said axial cylinder bores of said cylinder block means for drawing, compressing, and discharging a refrigerant gas, a drive mechanism for causing reciprocative movement of the pistons, at least one housing means arranged so as to close one axial end of said cylinder block means and having therein suction and discharge chambers, a valve plate means having a substantial thickness arranged between said one axial end of said cylinder block means and said housing means and having a plurality of suction ports for allowing entry of a refrigerant gas to be compressed from said suction chamber into said cylinder bores of said cylinder block means and a plurality of discharge ports for discharging a compressed refrigerant gas from said cylinder bores of said cylinder block means toward said discharge chamber of said housing means, each of said plurality of discharge ports having an inner end adjacent to each of said plurality of cylinder bores and an outer end adjacent to said discharge chamber of said housing means, a suction valve sheet means arranged between said one axial end of said cylinder block means and said valve plate means and defining a plurality of suction valves movable to open and close said plurality of suction ports in response to reciprocation of said plurality of said plurality of reciprocatory pistons and a plurality of discharge apertures for permitting the compressed refrigerant gas to flow from said cylinder bores of said cylinder block means toward said discharge ports of said valve plate means, and a discharge valve sheets means arranged between said valve plate means and said housing means and defining a plurality of discharge valves movable to open and close said discharge ports of said valve plate means in response to reciprocation of said plurality of reciprocatory pistons, wherein an improvement comprises turbulence generating means arranged adjacent to said each inlet end of each of said discharge ports for generating a turbulence in a flow of said compressed gas within each of said discharge ports so as to mitigate a pressure change in said compressed gas flow, acting on each of said plurality of discharge valves to thereby suppress pulsation in a pressure of said compressed gas flow, said turbulence generating means comprising an extension formed in at least a part of an edge of each said discharge aperture of said suction valve sheet means, said extension extending radially inwardly from said part of said edge of each of said discharge apertures of said suction valve sheet means toward the center thereof.

* * * * *